US009890620B2

(12) United States Patent
Maxted et al.

(10) Patent No.: US 9,890,620 B2
(45) Date of Patent: Feb. 13, 2018

(54) FIRING SWITCH AND METHOD OF OPERATION

(71) Applicant: Guardian Global Technologies Limited, Pyle, South Wales (GB)

(72) Inventors: Iain Maxted, Cowbridge (GB); Jonathan Gore, Finchampstead (GB); Jeremy Morgan, Treorchy (GB); Paul Bennett, Pontyclun (GB)

(73) Assignee: Guardian Global Technologies Limited, South Wales (GB)

( * ) Notice: Subject to any disclaimer, the term of this patent is extended or adjusted under 35 U.S.C. 154(b) by 0 days.

(21) Appl. No.: 15/027,560

(22) PCT Filed: Oct. 7, 2014

(86) PCT No.: PCT/GB2014/053023

§ 371 (c)(1),
(2) Date: Apr. 6, 2016

(87) PCT Pub. No.: WO2015/052509

PCT Pub. Date: Apr. 16, 2015

(65) Prior Publication Data

US 2016/0237794 A1 Aug. 18, 2016

(30) Foreign Application Priority Data

Oct. 7, 2013 (GB) ..... 1317674.8

(51) Int. Cl.
*F42B 3/182* (2006.01)
*E21B 43/1185* (2006.01)
(Continued)

(52) U.S. Cl.
CPC .... *E21B 43/11855* (2013.01); *E21B 41/0021* (2013.01); *F42B 3/182* (2013.01); *F42C 15/005* (2013.01); *F42C 15/20* (2013.01)

(58) Field of Classification Search
CPC ..... E21B 43/11855; F42B 3/182
(Continued)

(56) References Cited

U.S. PATENT DOCUMENTS 1,606,414 A * 11/1926 Grant ..... F42B 3/182 102/202.3
2,349,041 A * 5/1944 Hare ..... E21B 43/11857 175/4.51
(Continued)

FOREIGN PATENT DOCUMENTS

EP 0 207 749 A2 1/1987
GB 2 290 854 A 1/1996

OTHER PUBLICATIONS

International Search Report, PCT/GB2014/053023, dated Apr. 28, 2015, pp. 7.

*Primary Examiner* — Reginald Tillman, Jr.
(74) *Attorney, Agent, or Firm* — Chapin IP Law, LLC

(57) ABSTRACT

The present invention concerns a firing switch for a downhole ballistics device. More particularly, but not exclusively, this invention concerns a firing switch for a downhole ballistics device and a method of operating the firing switch. The invention also concerns various safety features relating to the firing switch. A firing switch arrangement for a downhole perforating gun (26, 28, 30, 32, 34) is provided, and comprises a firing switch (26', 28', 30', 32', 34'), and a detonator (40), the detonator arranged to be activated in response to an electrical signal from the firing switch. A removable safety tab (42) is associated with the detonator, the removable safety tab arranged to provide a short circuit to the detonator, such that the short circuit is removed if the removable safety tab is removed.

11 Claims, 3 Drawing Sheets

(51) Int. Cl.
*E21B 41/00* (2006.01)
*F42C 15/00* (2006.01)
*F42C 15/20* (2006.01)

(58) Field of Classification Search
USPC ..... 102/202.1–202.4
See application file for complete search history.

(56) References Cited

U.S. PATENT DOCUMENTS 2,724,333 A * 11/1955 Seavey ..... E21B 43/117
102/202.14
4,007,796 A 2/1977 Boop
4,628,818 A * 12/1986 Nilsson ..... F42B 3/182
102/202.2
4,967,048 A * 10/1990 Langston ..... F42D 1/045
166/55.1
5,027,708 A * 7/1991 Gonzalez ..... F42D 1/04
102/202.1
5,095,801 A * 3/1992 Lopez de
Cardenas ..... E21B 43/118
175/4.53
6,675,692 B1 * 1/2004 Goetz ..... B60R 21/13
102/202.1
7,789,153 B2 * 9/2010 Prinz ..... E21B 43/1185
102/222

* cited by examiner

FIRING SWITCH AND METHOD OF OPERATION

FIELD OF THE INVENTION

The present invention concerns a firing switch for a downhole ballistics device. More particularly, but not exclusively, this invention concerns a firing switch for a downhole ballistics device and a method of operating the firing switch. The invention also concerns various safety features relating to the firing switch.

BACKGROUND OF THE INVENTION

During oil or gas well operation, it is common to perforate the well casing in order to create a flow path for the oil and/or gas to flow into the well. This may be done by introducing downhole tools into the well casing typically using a single-conductor, steel armoured electrical cable, a 'logging' or 'wireline' cable. Such downhole tools may include perforating guns which fire explosive charges through the well casing. It is essential that the explosive charges are not detonated accidentally due to the potential damage they may cause and the risk to life they pose.

As the number of devices ('guns') in a downhole perforating string increases, so does the number of switch devices used to safely route power to the detonator when required. The current and voltage required to power the tool string also increases as there is a voltage drop across each switch. Explosive detonators have a certain minimum voltage required to initiate detonation. For safety reasons, it is important that the total power sent to a tool string comprising switch devices and detonator devices during normal, non-detonation events, is lower than the power required to initiate a detonator. Typically this limits the number of detonation devices that can be deployed in a tool string to 15 or fewer.

The present invention seeks to mitigate the above-mentioned problems. Alternatively or additionally, the present invention seeks to provide an improved detonation device.

SUMMARY OF THE INVENTION

The present invention provides, according to a first aspect, a firing switch arrangement for a downhole perforating gun comprising:

- a firing switch
- a detonator, the detonator arranged to be activated in response to an electrical signal from the firing switch; and
- a removable safety tab associated with the detonator, the removable safety tab arranged to provide a short circuit to the detonator, such that the short circuit is removed if the removable safety tab is removed.

The removable safety tab may be a break-off tab. The removable safety tab may be arranged such that it is not replaceable once removed.

The removable safety tab may protect against the detonator being activated in response to radio frequency (RF) signals, stray voltages or inadvertent application of a firing voltage to the switch. The removable safety tab may allow the firing switch arrangement to be used in an environment where radio frequency communications are used. The removable safety tab may be removed from the firing switch arrangement just prior to downhole deployment. The removable safety tab may be removed by a user snapping the tab. The removable safety tab may be a single use, non-replaceable, safety device, such that if removed it is not possible to replace the removable safety tab. The detonator may comprise detonator wires and/or terminals arranged to supply an electrical current to the detonator. The removable safety tab may provide a physical short circuit across the detonator wires or terminals.

The firing switch may comprise a temperature sensor, the temperature sensor arranged to prevent detonation of the detonator if the temperature of the perforating gun is below a predetermined threshold. This may prevent detonation before the firing switch is sufficiently deep in a well and additionally will prevent the firing of a gun which did not fire successfully in the well, on the retrieval of that gun to the surface. The temperature sensor may, therefore, act as an additional safety device.

The temperature sensor may comprise a second safety removable tab. Whilst the tab is in-situ, the temperature sensor is bypassed to allow testing of the switch prior to connection of a detonator. Removal of the tab prior to connection of a detonator may initiate the temperature sensor, such that detonation can take place only at a temperature above the predetermined threshold. The temperature sensor is an additional safety feature over and above the additional safety features identified herein and there may be a number of scenarios, where the terrain and depth of operation require detonation to take place at a lower temperature than the threshold temperature. In these cases the temperature sensor tab is left in place and the other safety features ensure the safe operation of the switch. The firing switch may comprise a gas discharge tube. The gas discharge tube may help protect the firing switch arrangement from lightning strikes.

According to a second aspect of the invention, there is also provided a downhole perforating gun comprising a firing switch arrangement, the firing switch arrangement in accordance with the first aspect of the invention.

According to a third aspect of the invention, there is also provide a downhole tool string, the downhole tool string comprising at least one downhole perforating gun according to the second aspect of the invention.

The downhole tool string may comprise a plurality of downhole perforating guns connected in a series arrangement via a power transmission line, each of the downhole perforating guns comprising a power switch arranged to enable or disable the transmission of power from one perforating gun to the next perforating gun.

Each of the power switches may be uniquely addressable. Providing uniquely addressed power switches allows detonation signals to be sent to specific perforating guns. A method of uniquely addressing and configuring a downhole tool string is described and claimed in UK patent application entitled "Downhole Tool System" with agent's reference "21883GB RNW", having the same filing date as the present application. The contents of that application are fully incorporated herein by reference. The claims of the present application may incorporate any of the features disclosed in that patent application. In particular, the claims of the present application may be amended to include features relating to the method and apparatus for addressing or configuring a downhole tool string.

Providing a plurality of uniquely addressed downhole power switches allows the selective firing of the perforating guns as required or desired.

The downhole tool string preferably comprises a surface control unit. The surface control unit may provide detonation signals to the downhole perforating guns. The surface control unit may also control the deployment of the downhole tool string, for example the depth to which the downhole tool string is lowered. The downhole tool string may comprise a one or more downhole tools which perform functions other than perforating guns. These downhole tools may be controlled by the same surface control unit, for safety reasons utilising a completely separate processor module. The control unit may also use a separate software interface for the same reason. Additionally, the non-perforating tools may be run with the opposite polarity to the perforating tools as an additional safety measure.

According to a fourth aspect of the invention, the invention also provides a method of deploying a downhole perforating gun, the downhole perforating gun according to the second aspect of the invention, comprising the steps of removing the removable safety tab from the firing switch arrangement and then lowering the perforating gun downhole. The method may also include the step of removing a temperature sensor safety tab prior to lowering the perforating gun downhole.

It will of course be appreciated that features described in relation to one aspect of the present invention may be incorporated into other aspects of the present invention. For example, the method of the invention may incorporate any of the features described with reference to the apparatus of the invention and vice versa.

DESCRIPTION OF THE DRAWINGS

Embodiments of the present invention will now be described by way of example only with reference to the accompanying schematic drawings of which.

DETAILED DESCRIPTION

Figure 1:
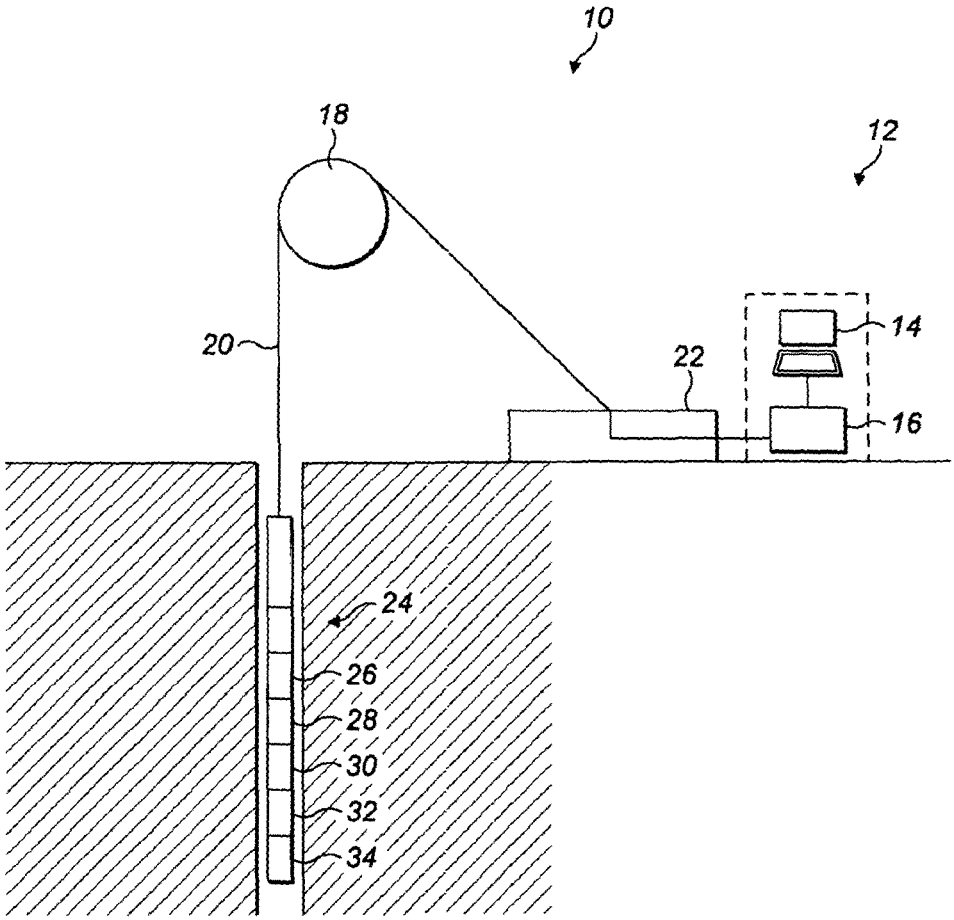
FIG. 1 shows a schematic view of a downhole tool string and control system according to a first embodiment of the invention.
Figure 2:
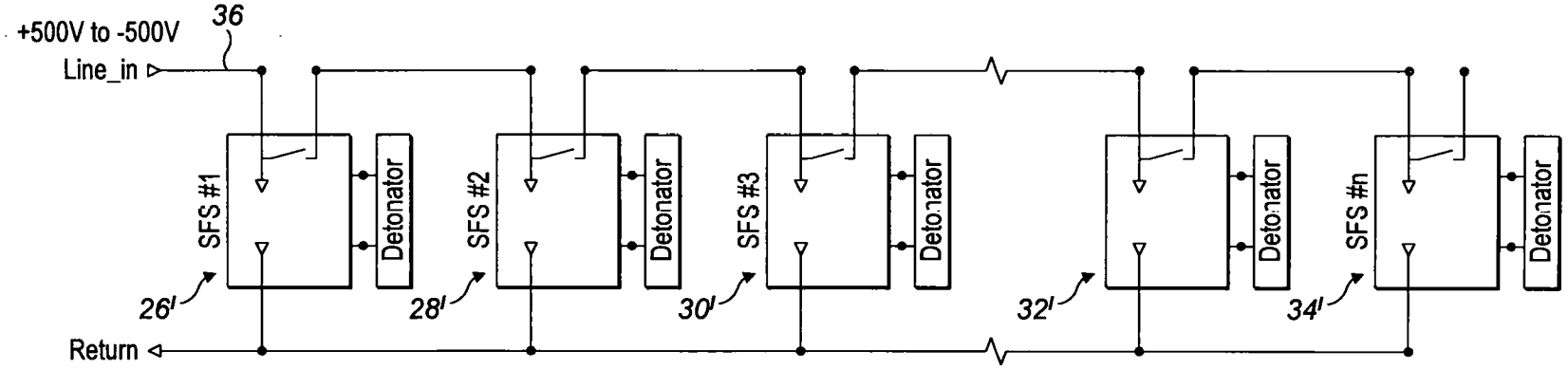
FIG. 2 shows a schematic view of a downhole perforating gun string which may be used in first embodiment of the invention.

FIG. 1 shows a downhole tool string and control system 10 comprising a control unit 12, the control unit comprising a computer processing unit 14 and a control panel 16. A hoist 18 supports a wireline 20 under the control of a winchman panel 22. The wireline 20 supports a downhole tool string 24 which comprises a plurality of downhole perforating guns 26, 28, 30, 32, and 34. Each of the downhole perforating guns comprises a firing switch 26', 28', 30', 32', and 34', as shown in FIG. 2. Whilst only five perforating guns and associated firing switches are shown, there may be many perforation guns and associated firing switches, for example, 10, 15, 20, 40 or more.

A power line 36 is connected to the first of the firing switches 26', such that the control device may send communication signals along the power line 36 to the firing switch 26'. The firing switches are connected in series, with the power line connecting an output of one firing switch to the input of the consecutive firing switch and so on. A high-side line switch and firing switch control unit as will be described in more detail with reference to FIG. 3, allows the surface control unit to uniquely address and configure the tool string as described and claimed in UK patent application entitled "Downhole Tool System" with agent's reference "21883GB RNW", having the same filing date as the present application. The contents of that application are fully incorporated herein by reference.

Providing each of the firing switches with unique addresses allows the surface control unit to selectively detonate any of the plurality of downhole perforating guns as required or desired. Advantageously, the unique address allows the detonation commands to be sent using the single control line 36 without risk of the wrong firing switch being activated. A number of additional safety features are shown in the expanded representation of a firing switch shown in FIG. 3.

Figure 3:
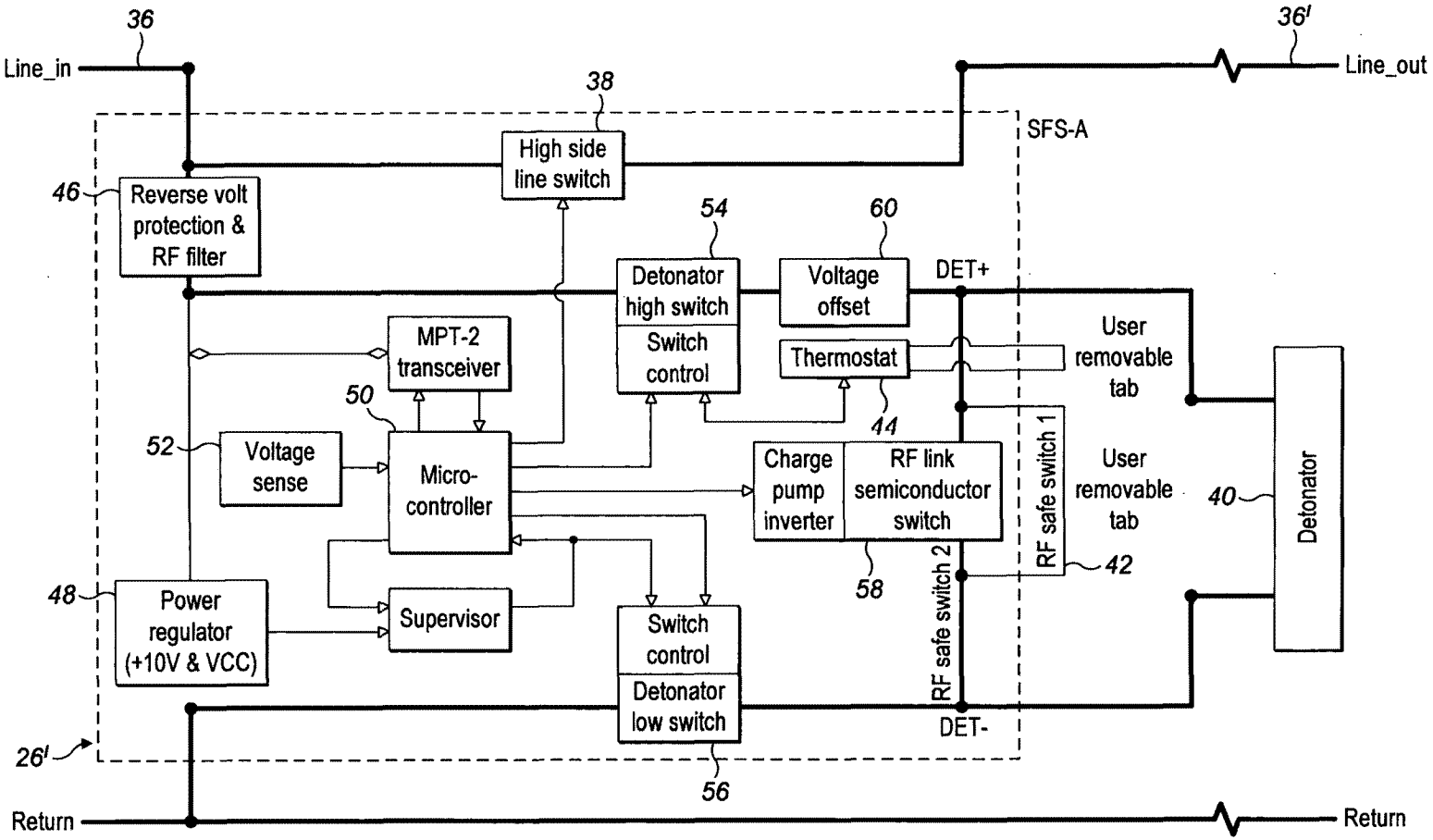
FIG. 3 shows a schematic circuit diagram of a firing switch which may be used in a downhole perforating gun according to the first embodiment of the invention.

FIG. 3 shows a firing switch 26' connected to a power line 36. As can be seen, the firing switch 26' is connected to a power out line 36'. The power out line 36' is connected to an input of the next firing switch 28' in the tool string. A high-side line switch 38 controls the power supply across the cables 36 to 36', such that when the high-side line switch 38 is open, power does not pass to the firing switch 28' and when the high-side line switch 38 is closed, power does pass to the firing switch 28'. The high-side line switch 38 enables the firing switch 26' to correctly power up and initiate the automatic address configuration routine as described below. The top-most firing switch 26' is configured, then the high-side line switch is switched on, enabling the next firing switch 28' to be configured, and so on until the entire tool string has been configured. The high-side line switch 38 also allows the firing switch 26' to be protected from short circuit in the possible event of the downstream control line 36' being shorted after a detonation event takes place.

The firing switch 26' is connected to a detonator 40 arranged to detonate an associated explosive charge. A variety of safety features are provided to prevent accidental detonation. A physical short-circuit of the detonator is provided by a user-removable tab 42. When the removable tab 42 is snapped off by a user, the physical short-circuit is removed. Once the removable tab 42 has been snapped, the tab cannot be replaced. The removable tab 42 helps protect against accidental detonation due to radio frequency enerty and stray or unintended voltages, for example when resistorised detonators are used. The removable tab 42 together with RF immunity circuitry allows a user to assemble the firing switch and detonator, and transport the assembly, without the needing to implement radio silence.

The firing switch also comprises a thermostat including a removable tab. The thermostat is arranged to prevent detonation unless a certain downhole temperature is reached. This ensures that the detonation only occurs once the firing switch is below a certain depth downhole. The removable tab enables the thermostat but may be left in place by a user when the particular operational requirements, for example shallow perforation, mean that the usual temperature conditions are not going to be reached. Once the removable tab has been snapped and the thermostat function implemented, the tab cannot be replaced.

The firing switch further comprises a reverse voltage protection unit 46 including two diodes. Overvoltage protection, for example due to lightning strikes, is protected against by providing the firing switch 26' with a gas discharge tube (not shown).

A voltage regulator 48 is provided as shown in FIG. 3. The firing switch also comprises a microcontroller 50, and a watchdog system monitoring a continuous stream of electrical pulses from the microcontroller. Should the microcontroller firmwear or hardware fail, the steam of pulses ceases and the watchdog circuit prevents further operation of the firing switch. The microcontroller 50 is arranged to receive communications and commands from the surface control unit 12 and send data back to the surface control unit 12. The microcontroller 50 may be used by the surface control unit 12 to assign the firing switch a unique address as described and claimed in UK patent application entitled "Downhole Tool System" with agent's reference "21883GB RNW", having the same filing date as the present application. The contents of that application are fully incorporated herein by reference.

The microcontroller 50 directly monitors the control line 36 voltage via an integral analogue-to-digital converter, translating the line voltage into a digital signal which is then communicated back to the surface control unit 12 at regular intervals. The voltage measurement at the firing switch 26' allows the surface control unit 12 to adapt the surface panel 16 voltage to ensure that the detonator connected to the firing switch 26' receives precisely the manufacturer's recommended voltage and current profile at all times and under all conditions.

The firing switch 26' also includes a voltage sense 52 configured to protect the firing switch 26' during fault conditions, for example in the event of a detonation event after which the downstream control wire 36' becomes shorted. The voltage sense 52 function ('short circuit protection mode') is implemented in the firing switch above the firing switch to be activated. On sensing a drop in a locally regulated voltage level indicating a short circuit of the detonator/switch below, the firing switch in short-circuit protection mode opens its high-side switch, thus disconnecting automatically the short circuit. Therefore, the firing switch above the detonated switch will respond to a fault condition and this arrangement removes the complication of tolerance matching or multi-threshold circuitry that may be required if this were not the case.

As has previously been described, the surface control unit 12 monitors the head voltage of the firing switch 26'. The surface control unit 12 is programmed by a user to know the type of detonator 40 being used in the system. This ensures that the surface control unit 12 supplies the correct detonation voltage and ramp rates when initiating a detonation event. Pre-determined voltage levels and ramp rates are stored within a memory of the surface control unit 12 for a range of industry standard detonators, allowing easy set up for a user.

For enhanced safety, the detonator 40 has three independent switches each requiring activation via a different mechanism before the detonator can be fired. A high-side detonator switch 54 and a low-side detonator switch 56 are arranged to be able to disconnect the detonator 40 from the control wire 36 and from the ground return. An important design features is that the high-side switch 54 (P-MOSFET) and low-side switch 56 are different types (N-MOSFET), such that the failure mode for each switch is different and each MOSFET has a different control system with different failure modes. A shorting switch 58 is also arranged to short the detonator wires together, the shorting switch 58 being a low-resistance semiconductor switch which is always on, even without the firing switch 26' being powered. Only when requested is the shorting switch 26' opened to allow current to flow through the detonator 40.

The high-side switch 54 is similar in arrangement to the high-side line switch 38. The high-side switch 54 is used to connect the positive supply to the detonator positive connection. This is performed through a high-voltage P-MOSFET. The P-MOSFET is controlled via a discreet NOR gate which evaluates the an input from the microcontroller 50 and from the thermostat 44, the thermostat set at 75 degrees Celsius. For safety reasons the design is such that the two inputs are from independent sources, the P-MOSFET driven via an output pin of the PIC24 microcontroller 50 and the other directly via the thermostat 44 circuitry. Two independent failures would need to happen simultaneously in order for the high-side switch 54 to fail.

The negative detonator wire is connected to a low-side detonator switch comprising a high-voltage N-MOSFET which connects the detonator to the ground return connection dia the outer shielding of the logging cable when requested to. The N-MOSFET is controlled by a discreet NAND gate, which evaluates inputs from the microcontroller 50 and from the previously mentioned watchdog IC. The watchdog is used to ensure that the firing switch 26' is fully operational. For safety reasons, the design is such that the two inputs are from independent sources. Two independent failures would need to occur simultaneously in order for the low-side switch 56 to fail.

The semiconductor switch 58 shorts out the detonator 40 terminals, ensuring that no high voltage can be induced across the detonator until the detonation signal has been sent. The semiconductor switch 58 comprises a depletion mode N-MOSFET. The semiconductor switch 58 is capable of shorting high currents during an error condition for a short period of time. Therefore, the semiconductor switch provides an additional safety measure to the high-side switch 54 and low-side switch 56.

The firing switch 26' further comprises a voltage offset circuit 60 to protect the detonator 40. The voltage offset circuit 60 is arranged to block a DC voltage to ensure that the detonator 40 sees zero voltage when the detonator switches are initially closed and the detonator 40 is connected to the wireline. The voltage offset circuit 60 may act as a voltage block up to the firing switch 26' head voltage, which is typically 25 $V_{DC}$. This provides an important safety feature as for most detonators, it is recommended that instantaneous voltages are not applied to them as this may damage the detonator causing a misfire.

The firing switch 26' also comprises an RF filter in order to filter out radio frequency energy that are present around a production field. Such RF energy may induce a voltage in a firing switch and it is important the coupled energy is not transferred to the detonator terminals.

Whilst the present invention has been described and illustrated with reference to particular embodiments, it will be appreciated by those of ordinary skill in the art that the invention lends itself to many different variations not specifically illustrated herein. By way of example only, certain possible variations will now be described.

The downhole tool string may comprise additional downhole tools with functions other than perforating guns. These downhole tools may be controlled by the same surface control unit as the perforating guns. However, for safety reasons, a completely separate processor module may be used. The control unit may also use a separate software interface for the same reasons. The non-perforating tools may be run with opposite polarity to the perforating tools as an additional safety measure.

Where in the foregoing description, integers or elements are mentioned which have known, obvious or foreseeable equivalents, then such equivalents are herein incorporated as if individually set forth. Reference should be made to the claims for determining the true scope of the present invention, which should be construed so as to encompass any such equivalents. It will also be appreciated by the reader that integers or features of the invention that are described as preferable, advantageous, convenient or the like are optional and do not limit the scope of the independent claims.

Moreover, it is to be understood that such optional integers or features, whilst of possible benefit in some embodiments of the invention, may not be desirable, and may therefore be absent, in other embodiments.

The invention claimed is:

1. A firing switch arrangement for a downhole perforating gun comprising:

a firing switch, a detonator, the detonator arranged to be activated in response to an electrical signal from the firing switch; and a removable safety tab associated with the detonator, the removable safety tab arranged to provide a short circuit to the detonator, such that the short circuit is removed if the removable safety tab is removed, the removable safety tab being a single use, non-replaceable, safety device;

the firing switch further comprising a temperature sensor including a second removable safety tab, the temperature sensor arranged to prevent detonation of the detonator if the temperature of the perforating gun is below a pre-determined temperature, such that removal of the second removable safety tab initiates the temperature sensor.

2. A firing switch arrangement as claimed in claim 1, wherein the removable safety tab is removed by a user snapping the tab.

3. A firing switch arrangement as claimed in claim 1, wherein the detonator comprises detonator terminals arranged to supply an electrical signal to the detonator and the removable safety tab provides a physical short circuit across the detonator terminals.

4. A firing switch arrangement as claimed in claim 2, further comprising a gas discharge tube.

5. A firing switch arrangement as in claim 1 further comprising a downhole tool string, the downhole tool string comprising at least one downhole perforating gun.

6. A downhole tool string as claimed in claim 5, comprising a plurality of downhole perforating guns connected in a series arrangement via a power transmission line, each of the downhole perforating guns comprising a power switch arranged to enable or disable the transmission of power from one perforating gun to the next perforating gun.

7. A downhole tool string as claimed in claim 6, wherein each of the downhole perforating guns is uniquely addressable.

8. A downhole tool string as claimed in claim 7, further comprising a surface control unit.

9. A downhole tool string as claimed in claim 8, comprising one or more non-perforating tools controlled by the surface control unit, the non-perforating tools run on the opposite polarity to the downhole perforating guns.

10. A method of deploying a downhole perforating gun comprising:

providing a firing switch, deploying a detonator, the detonator arranged to be activated in response to an electrical signal from the firing switch; and associating a removable safety tab associated with the detonator, the removable safety tab arranged to provide a short circuit to the detonator, such that the short circuit is removed if the removable safety tab is removed, the removable safety tab being a single use, non-replaceable, safety device;

disposing, on the firing switch, a temperature sensor including a second removable safety tab, the temperature sensor arranged to prevent detonation of the detonator if the temperature of the perforating gun is below a pre-determined temperature, such that removal of the second removable safety tab initiates the temperature sensor.

11. A method of deploying a downhole perforating gun, as claimed in claim 10, further comprising the steps of removing the removable safety tab from the firing switch and then lowering the perforating gun downhole.

* * * * *